US005544789A

United States Patent [19]

Gillingham

[11] Patent Number: 5,544,789

[45] Date of Patent: Aug. 13, 1996

[54] BELLOWS PUMP DISPENSER

[75] Inventor: James R. Gillingham, Hacienda Heights, Calif.

[73] Assignee: Calmar Inc., City of Industry, Calif.

[21] Appl. No.: 369,114

[22] Filed: Jan. 5, 1995

[51] Int. Cl.[6] ..... B67D 5/33

[52] U.S. Cl. ..... 222/153.13; 222/207

[58] Field of Search ..... 222/153.04, 153.13, 222/207, 209, 211, 213, 382, 383.1, 321.7

[56] References Cited

U.S. PATENT DOCUMENTS

| | | | |
|---|---|---|---|
| 2,702,147 | 2/1955 | Brown | 222/207 |
| 3,785,532 | 1/1974 | Cooprider | 222/207 |
| 3,987,938 | 10/1976 | Cooperider et al. | 222/209 |
| 4,057,177 | 11/1977 | Laauwe | 222/215 |
| 4,088,248 | 5/1978 | Blake | 222/207 |
| 4,589,573 | 5/1986 | Tada | 222/214 |
| 4,732,549 | 3/1988 | von Schuckmann | 222/207 |
| 4,863,070 | 9/1989 | Andris | 222/207 |
| 4,915,601 | 4/1990 | von Schukmann | 222/153.13 |
| 5,014,881 | 5/1991 | Andris | 222/207 |
| 5,238,156 | 8/1993 | Andris | 222/207 |

FOREIGN PATENT DOCUMENTS

WO95/01226 1/1995 WIPO .

*Primary Examiner*—Andres Kashnikow
*Assistant Examiner*—Philippe Dergkshani
*Attorney, Agent, or Firm*—Watson Cole Stevens Davis, P.L.L.C.

[57] ABSTRACT

A bellows dispenser has a plunger lock down feature in a non-use position such as shipping and storage. During plunger lock down a bearing member on the plunger seals the bellows about a container vent opening valve seat for avoiding any leakage in such non-use position.

8 Claims, 2 Drawing Sheets

FIG. 1
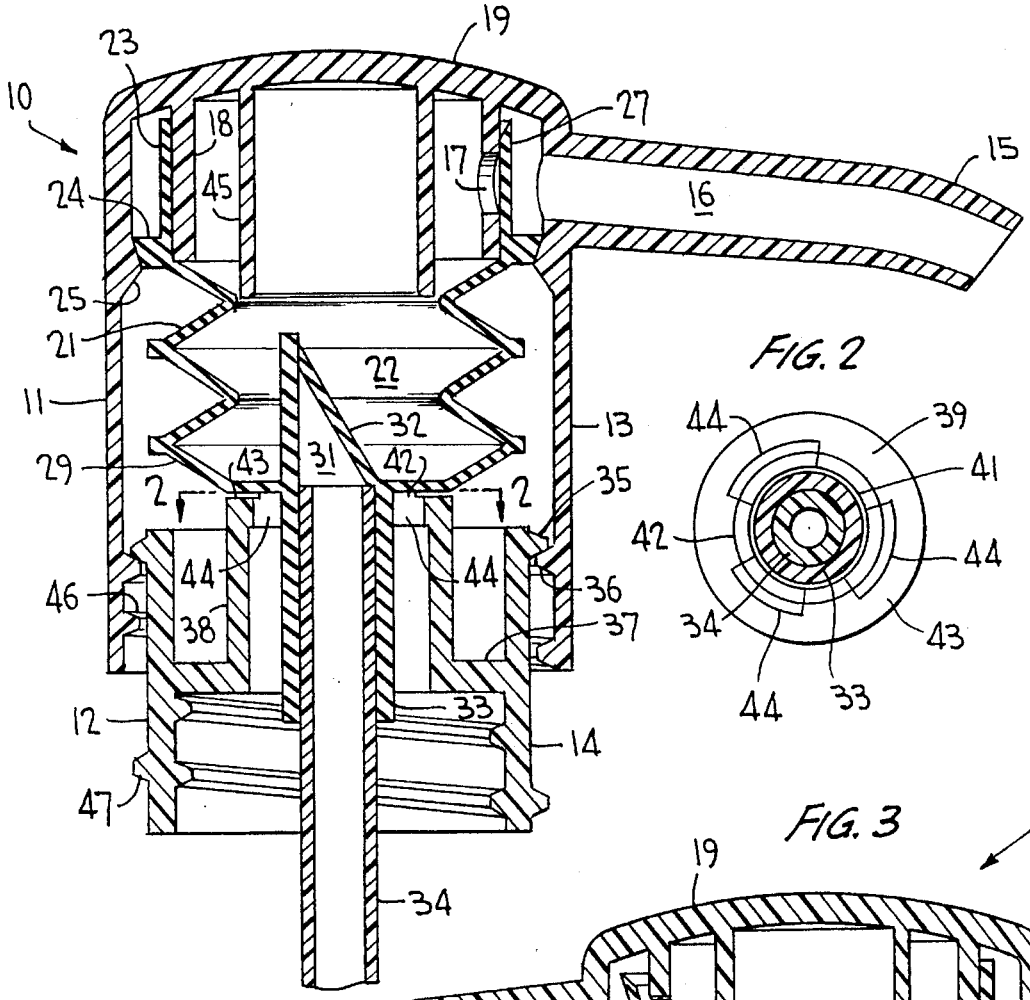
FIG. 2
FIG. 3
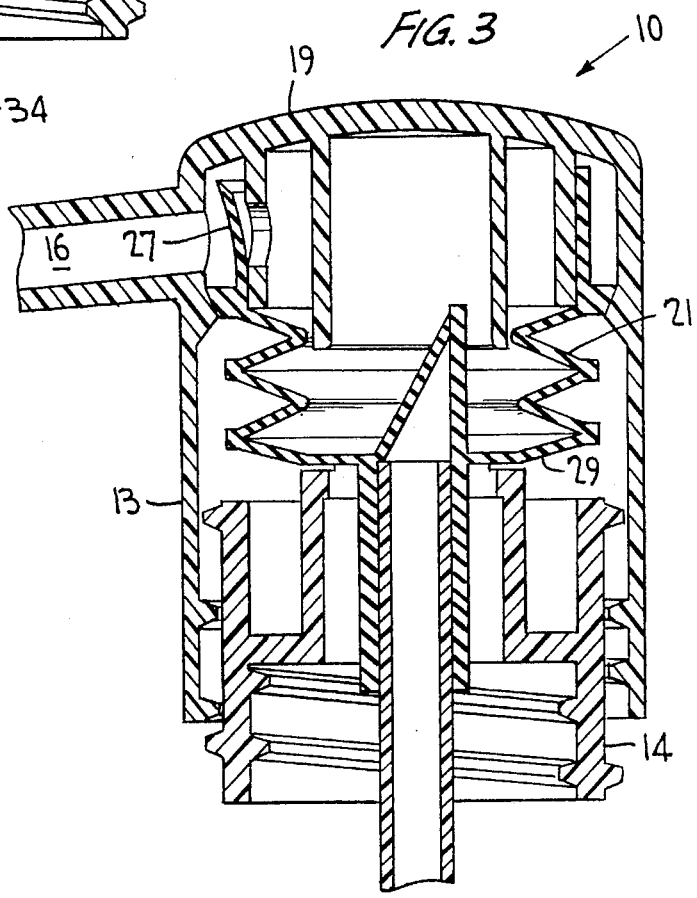

BELLOWS PUMP DISPENSER

BACKGROUND OF THE INVENTION

This invention relates generally to a bellows pump dispenser, and more particularly to such a dispenser in which the bellows is utilized to seal the container vent opening closed in a locked down position of the plunger during non-use conditions such as shipping and storage.

Pump dispensers having a tubular resilient bellows defining a pump cheer located within a pair of relatively reciprocable parts of a pump housing, are known. Such prior art dispensers are normally provided with a valve controlled container vent opening for replacing product dispensed from the container with air to avoid container collapse during dispensing and to aid in priming the bellows pump cheer. The container vent valve, normally one-way, may comprise a resilient lip or flap valve responding to a differential pressure for opening the vent to admit air into container as the pressure within the container drops below atmospheric. However, problems may arise during non-use conditions such as shipping and storage of the dispenser package as product tends to leak through the open container vent during pressure fluctuations acting on opposite sides of the container vent valve. Moreover, should the pump plunger be accidentally depressed during shipping and handling, product is likely to leak through the discharge passage.

The need therefore arises for locking the plunger against reciprocation during periods of non-use, and for sealing the container vent closed during the plunger lock condition.

SUMMARY OF THE INVENTION

It is therefore an object of the present invention to provide a bellows pump dispenser having a plunger lock down feature which avoids inadvertent plunger reciprocation during periods of non-use. In the locked down condition, the container vent opening is sealed closed as a portion of the resilient bellows is sealed about the vent opening.

The dispenser according to the invention has the bellows seated at one end between a pair of relatively reciprocable dispenser housing parts. The bellows has a valve controlled inlet and outlet, and one of the housing parts comprises a finger actuated plunger. The plunger has a bearing element which sealingly engages the bellows against the other housing part adapted to be mounted on a container of product to be dispensed. The bellows is sealingly engaged in a condition of non-use such as in a shipping and storage position in which the plunger is fully depressed, and cooperating means on the housing parts are provided for locking the dispenser in such condition of non-use.

That housing part which is mounted to the container has an end wall containing the container vent opening surrounded by a valve seat such that, in the plunger lock down position, the bearing element engages the valve seat for sealing the vent closed. The valve seat may be annular and the bearing element may comprise a hollow depending sleeve extending into the interior of the bellows.

The cooperating means on the housing parts may comprise screw threads, and the bellows may be affixed to the plunger for rotation together therewith about the central axis of the dispenser upon threading down of the plunger into its locked down position.

Other objects, advantages and novel features of the invention will become more apparent from the following detailed description of the invention when taken in conjunction with the accompanying drawings.

BRIEF DESCRIPTION OF THE DRAWINGS

FIG. 1 is a vertical sectional view of the bellows dispenser according to the invention showing the dispenser in an unlocked position ready for use;

FIG. 2 is a part sectional view taken substantially along the line 2—2 of FIG. 1;

FIG. 3 is a view similar to FIG. 1 showing the plunger in use upon plunger reciprocation;

DETAILED DESCRIPTION OF THE INVENTION

Figure 4:
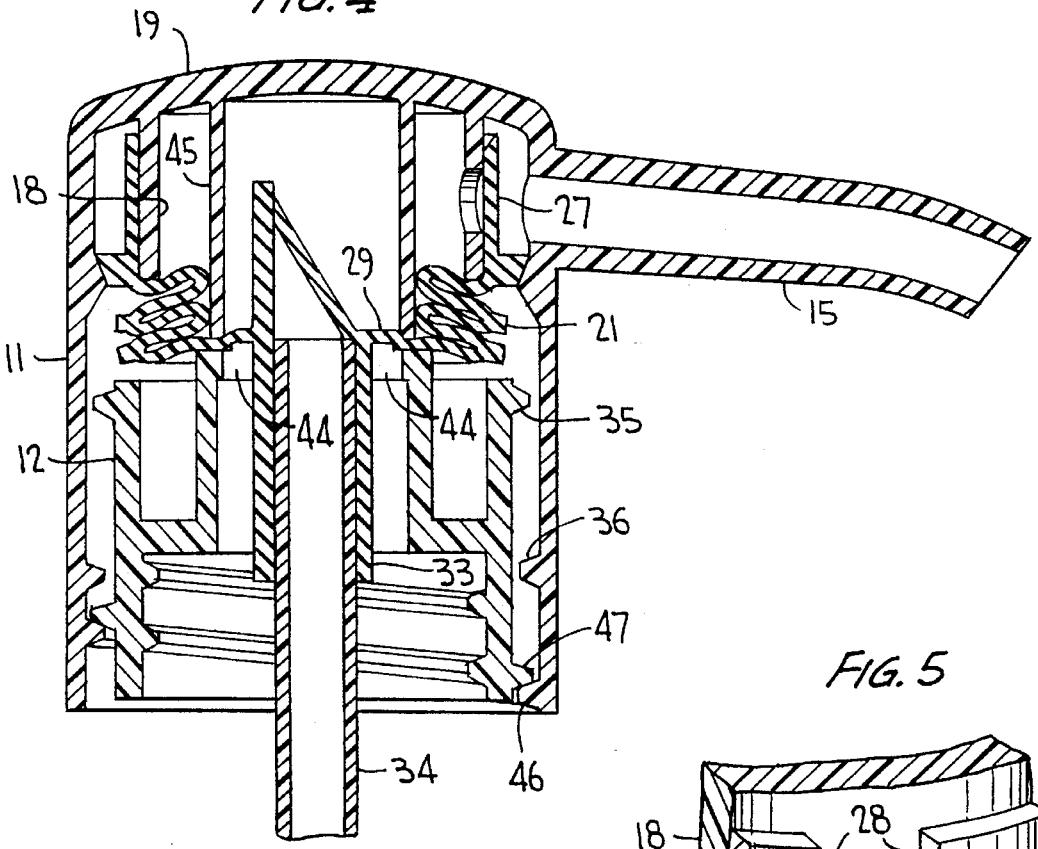
FIG. 4 is a view similar to FIG. 1 showing the plunger in a locked down position with the container vent sealed closed against leakage.

Turning now to the drawings wherein like reference characters refer to like and corresponding parts throughout the several views, the dispensing pump according to the invention is generally designated 10 in FIG. 1, the plunger having a housing including a pair of relatively reciprocable parts 11 and 12. One of the parts 11, forming a reciprocable plunger, has a cylindrical sidewall 13 telescoped over sidewall 14 of the other part 12 for reciprocating movement between the FIGS. 1 and 3 positions. Part 12, in the form of a container closure having a circular sidewall 14, is internally threaded for threaded engagement with the neck of a container (not shown) of product to be dispensed.

A discharge spout 15 defining a discharge passage 16 extends from an outlet 17 located in an inner depending annular flange 18 within the plunger. Top end 19 of the plunger comprises a finger rest for the operator during dispensing.

Figure 5:
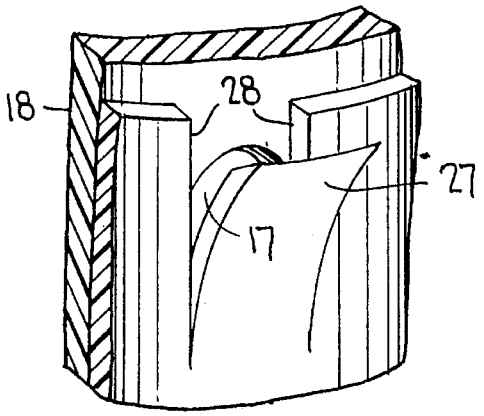
FIG. 5 is a detail perspective view of the bellows valve controlled outlet opening showing the valve open during dispensing.

A bellows 21, of resilient plastic or elastomeric material, defines a pump chamber 22, and is mounted within parts 11 and 12. One end 23 of the bellows surrounds flange 18 and is sealed in place by the provision of an annular bead 24 which may be snap fitted against an annular bead 25 formed at the inner wall of the plunger. The bellows is thereby fixedly mounted to the plunger, and end 23 has a resilient one-way flap valve 27 or the like formed therein by the provision of spaced slits 28 (FIG. 5).

Figure 6:
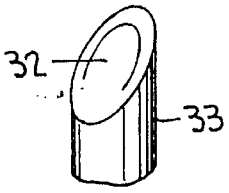
FIG. 6 is a perspective view of the bellows valve controlled inlet showing the valve closed.

Lower end 29 of the bellows, opposite its one end 23, may be closed as shown and contains an inlet passage 31 controlled by a one-way valve 32. As more clearly shown in FIGS. 6 and 7, inlet valve 32 may comprise an integral flap valve 32 formed at the upper end of sleeve 33. This sleeve 33, depending from the bellows, supports a dip tube 34 extending as in the normal manner into a container (not shown) of product on which the dispenser is mounted.

The bellows is capable of applying the restoring forces between the two housing parts 11 and 12 during the dispensing operation, and arresting means in the form of beads 35 and 36 on the outer face of wall 14 and on the inner face of wall 13, respectively, limit the upper travel of the plunger relative to part 12.

Part 12 has an end wall 37 with a central upstanding crown 38 having an upper end wall 39 (FIG. 2) with a central opening 41 slightly oversized relative to sleeve 33 extending therethrough. End wall 39 has a slightly raised annular portion 42 for slightly elevating bottom end 29 of the bellows above upper surface 43 of wall 39, as clearly shown in FIG. 1.

And, upper end wall 39 contains one or more vent openings 44 communicating with the interior of the container (not shown) and, in the upwardly extended position of the plunger shown in FIG. 1, communicates with the atmosphere via an annular passage formed between upper surface 43 and the lower surface of bottom wall 29. Upper surface 43 likewise presents a valve seat for the container vent openings as will be more fully described hereinafter.

A bearing member which may be in the form of a depending hollow sleeve 45 extends inwardly from top end 19 of the plunger into the interior of the bellows.

For locking down the plunger in its fully depressed position over part 12, cylindrical sidewalls 13 and 14 are provided with internal and external threads 46 and 47, respectively. In such a fully depressed condition of the plunger shown in FIG. 4, part 11 is threaded about part 12 as threads 46 and 47 interengage for locking the plunger in its fully depressed condition. In such condition, the lower edge of bearing sleeve 45 engages bottom wall 29 of the bellows and compresses wall 29 against vent valve seat 43 located outwardly and surrounding vent openings 44. Vent openings 44 are thus sealed closed in the plunger locked down position of FIG. 4. In this position, the flutes of the bellows are collapsed into stacked folds as aided by flange 18 and are located external to bearing member 45.

Since the bellows is secured at its upper end to part 11, it rotates together with the plunger about its central axis when the plunger is lowered and locked into its FIG. 4 position of non-use such as shipping and storage. In this position, the plunger head cannot be inadvertently depressed or knocked, and leakage through the sealed vent passage is completely avoided.

Figure 7:
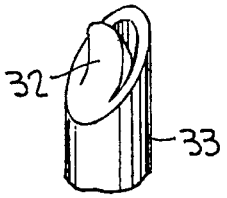
FIG. 7 is a view similar to FIG. 5 showing the valve open during the suction stroke of the pump dispenser.

In operation, assuming pump chamber 22 is primed with product with the plunger unlocked as in FIG. 1, external finger pressure applied against top end 19 of the plunger lowers the plunger against the inherent spring force of the bellows compressing the fluid in the pump chamber which forces outlet valve 27 open, as shown in FIG. 3. Upon release of the external finger force, the restoring force of the bellows returns the plunger to its FIG. 1 position establishing a sub-atmospheric pressure in the pump chamber which effects a drawing in of product to the pump chamber through open inlet valve 32 (FIG. 7).

During the dispensing operation, the container vents are open for replenishing the product discharged from the container with air to avoid container and bellows collapse.

In a non-use condition of the dispenser, such as during shipping and storage, the plunger is fully depressed and is threaded down into its locked position of FIG. 4. In such condition sleeve 45 compresses lower end 29 of the bellows against valve seat 43 for positively sealing the container vents closed to avoid leakage.

The plunger is simply unthreaded and allowed to raise back to its FIG. 1 unlocked position in readiness for use.

Although a resilient inlet flap valve is shown, other type valves are possible such as duckbill valves and the like. Also, other outlet valves than the type shown are possible, without departing from the invention.

The bellows dispenser of the invention can be modified as a sprayer in which case the discharge spout would be eliminated and replaced by a spray orifice cup, without departing from the invention.

Also, the cooperating lock-down threads on the two housing parts of the dispenser can be replaced by cooperating lock beads or the like within the scope of the invention.

Obviously, many other modifications and variations of the present invention are made possible in the light of the above teachings. It is therefore to be understood that within the scope of the appended claims the invention may be practiced otherwise than as specifically described.

What is claimed is:

1. A pump dispenser, comprising, a housing including a pair of relatively reciprocable parts, a tubular resilient bellows defining a pump chamber and being sealed at one end between said parts, said bellows having a valve controlled inlet and outlet, one of said parts including a discharge passage communicating with said valve controlled outlet, the other of said parts having a container vent opening and being adapted for mounting the dispenser to a container of product to be dispensed, the improvement wherein said other part has a wall containing said vent opening and a valve seat surrounding said opening, an end of said bellows opposite said one end overlying said vent opening, said one part having a bearing element for sealingly engaging said bellows against said valve seat in a non-use position of shipping and storage in which said one part is fully depressed relative to said other part for sealing said container vent closed, and cooperating means on said parts for locking the dispenser in said non-use position.

2. The dispenser according to claim 1, wherein said opposite end contains said valve controlled inlet.

3. The dispenser according to claim 1, wherein said cooperating means comprise telescoping side walls on said parts having cooperating lock beads.

4. The dispenser according to claim 3, wherein said lock beads comprise cooperating threads requiring relative rotation of said parts for locking the dispenser in said non-use position.

5. The dispenser according to claim 1, wherein said one end of said bellows is sealed to said one part, said valve controlled outlet comprising a flap valve integral with said bellows.

6. The dispenser according to claim 5, wherein said cooperating means comprise telescoping side walls on said parts having cooperating threads such that relative rotation of said parts locks the dispenser in said non-use position.

7. A pump dispenser, comprising, a housing including a pair of relatively reciprocable parts, a tubular resilient bellows defining a pump chamber and being sealed at one end between said parts, said bellows having a valve controlled inlet and outlet, one of said parts including a discharge passage communicating with said valve controlled outlet, the other of said parts having a container vent opening and being adapted for mounting the dispenser to a container of product to be dispensed, the improvement wherein said other part has a wall containing said vent opening, an end of said bellows opposite said one end overlying said vent opening, said one part having a bearing element with a bearing edge disposed outwardly of said vent opening for sealing said opposite end of said bellows against said wall of said other part in said non-use position.

8. The dispenser according to claim 7, wherein said bearing element extends into the interior of said bellows and comprises a hollow sleeve.

* * * * *